United States Patent [19]

Cremosnik et al.

[11] Patent Number: 4,709,875

[45] Date of Patent: Dec. 1, 1987

[54] APPARATUS FOR GUIDING A MISSILE

[75] Inventors: Gregor Cremosnik, Regensdorf; Joachim Timper, Zürich; Johann Holzberger, Schöfflisdorf, all of Switzerland

[73] Assignee: Werkzeugmaschinenfabrik Oerlikon-Bührle AG, Zürich, Switzerland

[21] Appl. No.: 5,697

[22] Filed: Jan. 22, 1987

[30] Foreign Application Priority Data

Jan. 30, 1986 [CH] Switzerland ..... 00349/86

[51] Int. Cl.[4] ..... F41G 7/26

[52] U.S. Cl. ..... 244/3.13

[58] Field of Search ..... 244/3.13

[56] References Cited

U.S. PATENT DOCUMENTS

| | | | |
|---|---|---|---|
| 3,398,918 | 8/1968 | Girault | 244/3.13 |
| 3,690,594 | 9/1972 | Menke | 244/3.13 |
| 3,782,667 | 1/1974 | Miller, Jr. et al. | 244/3.13 |
| 4,014,482 | 3/1977 | Esker et al. | 244/3.13 |
| 4,174,818 | 11/1979 | Glenn | 244/3.13 |
| 4,186,899 | 2/1980 | Stewart, Jr. | 244/3.13 |
| 4,209,224 | 6/1980 | Stewart, Jr. | 244/3.13 |
| 4,245,800 | 1/1981 | Henderson | 244/3.13 |
| 4,299,360 | 11/1981 | Layton | 244/3.13 |
| 4,313,580 | 2/1982 | Collette | 244/3.13 |
| 4,424,944 | 1/1984 | Wes et al. | 244/3.13 |

FOREIGN PATENT DOCUMENTS

| | | |
|---|---|---|
| 1958139 | 5/1971 | Fed. Rep. of Germany . |
| 3311349 | 10/1984 | Fed. Rep. of Germany . |
| 2337365 | 7/1977 | France . |
| 2458044 | 12/1980 | France . |
| 2066431 | 7/1981 | United Kingdom . |

*Primary Examiner*—Charles T. Jordan

*Attorney, Agent, or Firm*—Werner W. Kleeman

[57] ABSTRACT

The apparatus for guiding a missile generates an electromagnetic guide beam such as a $CO_2$-laser guide beam including spatial coding. For spatially encoding the guide beam there is employed a modulator as well as a scanning device which are intercoupled by means of a computer. The guide beam is moved in steps or increments by the scanning device in order to scan individual field sectors of a scanning field. Following each individual step, a code is transferred to or associated with a scanned field sector of the scanning field by the guide beam such that for each field sector of the scanning field a code is generated which indicates the actual position of the missile, and a code which indicates the desired position of the missile. Consequently, a number of missiles can be guided simultaneously in different field sectors.

20 Claims, 3 Drawing Figures

APPARATUS FOR GUIDING A MISSILE

BACKGROUND OF THE INVENTION

The present invention broadly relates to a new and improved construction of an apparatus for guiding a missile by means of an electromagnetic guide beam.

In its more particular aspects the present invention specifically relates to a new and improved construction of an apparatus for guiding a missile by means of an electromagnetic guide beam along a trajectory along which the missile is intended to move towards a target. In each arrangement the guide beam is encoded such that the missile receives data on the basis of which the missile can move along the desired trajectory.

In an apparatus for guiding a missile as known, for example, from U.S. Pat. No. 3,398,918, granted Aug. 27, 1968, there is generated an optical guide beam by means of a light source and the missile is guided by the optical guide beam from a launching base or site towards a target. Means are present for diverting the source guide beam such that the beam cross-section is defined by intersecting diverted beams. Further means are provided for modulating and deflecting the diverted or fanned source beam such that each diverted beam is differently modulated. The missile contains a receiver with photoelectric cells as well as control means in order to guide the missile along the guide beam towards the target.

In another apparatus of this type for guiding a missile and as known, for example, from U.S. Pat. No. 4,174,818, granted Nov. 20, 1979, a guide beam is generated by means of a light source and along a trajectory along which the missile is intended to be moved or guided. By means of a turning mask the guide beam cross-sectional area is subdivided into a checkerboard-type area or pattern. Each field sector of the checkerboard-type cross-sectional area possesses an individual code such that the receiver located in the missile can identify its location in a specific field sector of the guide beam's cross-sectional area.

It is also known to modulate an electromagnetic guide beam of an apparatus for guiding a missile. Distinctions are made between analogue and digital modulation as well as between amplitude, phase and frequency modulation so that there result six different types of modulation.

A digital frequency modulation of the guide beam in an apparatus for guiding a missile is described, for example, in U.S. Pat. No. 4,299,360, granted Nov. 10, 1981. In this known apparatus there are used two rotating encoding discs which contain through-pass openings permitting the guide beam to pass through and serving for modulating the guide beam in correspondence to their arrangement on the encoding disc.

Another known frequency modulation technique for spatially encoding the guide beam cross-section in an apparatus for guiding a missile such as known, for example, from U.S. Pat. No. 3,782,667, subdivides the guide beam into four quadrants with respect to frequency due to the use of four radiation sources each of which operates at a different frequency. The modulated radiation from the four radiation sources is combined to form a single beam having the desired spatial modulation.

It has been found that the known apparatuses can be simplified and improved.

SUMMARY OF THE INVENTION

Therefore, with the foregoing in mind it is a primary object of the present invention to provide a new and improved construction of an apparatus for guiding a missile by means of an electromagnetic guide beam and which apparatus is of comparatively simple but very effective construction.

It is a further significant object of the present invention to provide a new and improved construction of an apparatus for guiding a missile by means of an electromagnetic guide beam and which apparatus, although of comparatively simple construction, offers the smallest possible risk that the missile inadvertently departs from its guide beam and thus no longer becomes guideable.

Now in order to implement these and still further objects of the present invention, which will become more readily apparent as the description proceeds, the apparatus of the present development is manifested by the features that, means for step-by-step or incremental deflection of the guide beam and means for encoding the guide beam are mutually coupled by means of a computer in order to generate an individual code for each field sector of a scanning field.

Preferably there is generated a checkerboard-type scanning field by the means for deflecting the guide beam and each field sector is assigned an individual code by the means for encoding the guide beam. Instead of a checkerboard-type scanning field, there can also be generated a scanning field defined by a circularly or spirally shaped or any other appropriately shaped scanning pattern.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the structure of the apparatus for guiding a missile or the like has been illustrated therein, as is needed to enable one skilled in the art to readily understand the underlying principles and concepts of the present invention. Generally, the inventive apparatus for guiding a missile renders possible guiding one or a number of missiles such as rockets or projectiles by means of a guide beam during their flight until they have reached their targets. This novel apparatus has the following advantages as compared to the aforementioned prior art guiding apparatuses:

(a) There is less power required for generating the guide beam.

(b) The encoding of the guide beam can be freely selected and changed at any time.

(c) The data transmission rate is high, i.e. relatively large amounts of data per unit of time can be transmitted from the transmitter to the receiver within the missile.

The invention essentially consists of firstly modulating a guide beam, particularly a $CO_2$-laser beam by means of an acousto-optical or electro-optical crystal and using a code containing the information to be transmitted. The coded guide beam is deflected using appropriate deflecting means like, for example, a deflecting or scanning mirror, in a manner such that there is generated by the deflecting means, for example, a checkerboard-type scanning field containing $8\times8$ field sectors. In this arrangement, the deflected guide beam remains within each field sector for a duration required to transmit the necessary data and only then jumps to the next field sector.

Figure 1:
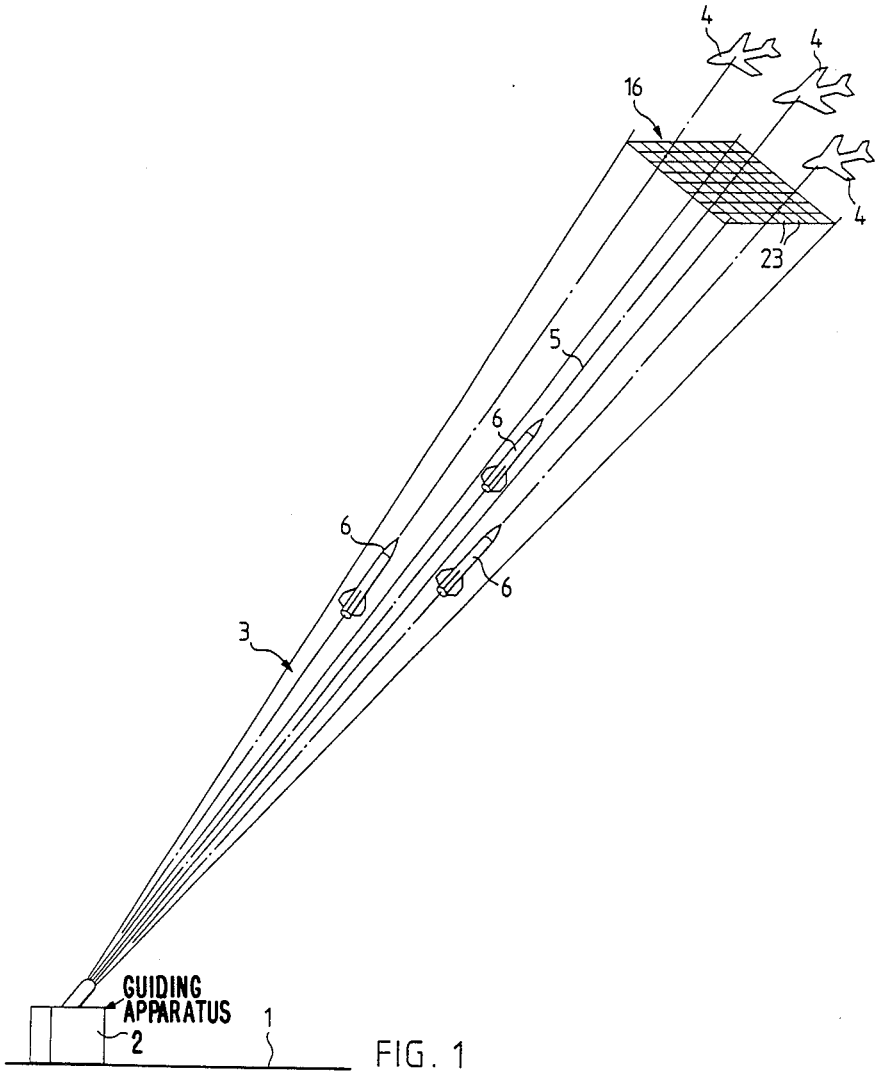
FIG. 1 shows a schematic illustration of an exemplary embodiment of the complete arrangement of the inventive apparatus for guiding a missile from a launching base or launcher site to a target.

Turning now specifically to FIG. 1 of the drawings, the invention guiding apparatus illustrated therein by way of example and not limitation, will be seen to guide a missile 6 to a target 4 by means of a guide beam 3. On the ground 1 there is located a guiding apparatus 2 which directs the guide beam 3 towards the target 4 to be attacked. A directional axis 5 is indicated by a dash-dotted line at the center of the guide beam 3. The missile 6 is intended to be guided towards the target 4 within this guide beam 3. The guide beam 3 is continuously directed towards the moving target 4, for example, by means of a target tracking device which is of conventional construction and therefore not here illustrated. Instead of using such target tracking device the guide beam 3 may also be manually moved to track the target 4 until the missile 6 has reached the target 4.

The guide beam 3 must have a sufficiently large cross-sectional area in order to ensure that the missile 6 cannot fly out of the guide beam 3 after it has been located within this guide beam 3. Using the inventive guiding apparatus, there is generated a guide beam 3 which, as compared to known guide beams, requires less power for its generation, i.e. the power for generating the guide beam 3 is smaller than previously required because only a field sector of the scanning field is illuminated. The coding is intended to be freely selectable and also to be freely variable. This is not the case for heretofore known guiding apparatuses. Furthermore, the data transmission rate is intended to be high.

The guiding apparatus 2 according to the invention contains the following apparatus components:

(a) a device or means for generating the electromagnetic guide beam 3;

(b) a device or means for diverting or fanning the guide beam 3 and for adjusting its divergence;

(c) a modulator for encoding the guide beam 3, e.g., by means of an acousto-optical or electro-optical crystal;

(d) zoom optics for adjusting the guide beam 3 to a desired cross-sectional area at any desired distance from the guiding apparatus 2;

(e) a device or means for deflecting the modulated guide beam 3, e.g., by means of a deflection mirror or scanning mirror or by means of a crystal for generating a scanning field.

These apparatus components will now be described in greater detail hereinbelow.

(a) Device or means for generating the electromagnetic guide beam 3:

Wavelength of such guide beam 3, for example, about 1.06 or 10.6$\mu$. $CO_2$-lasers or neodymium lasers having an output power in the range of 1 to about 30 watts have been found to be particularly suitable.

(b) Device or means for diverting or fanning the guide beam 3 and for adjusting its divergence:

For diverting or fanning the guide beam 3 there is used an "IR beam expander" which pemits multiply diverting or fanning the guide beam 3. This device or means is suitable for guide beams 3 having a wavelength of about 10.6$\mu$ of the type as generated by a $CO_2$-laser. Such device or means permits adjusting the divergence of the guide beam 3.

(c) Modulator for encoding the guide beam 3:

For modulating and encoding the guide beam 3, there is employed an acousto-optical or electro-optical modulator. The electronic driver circuit required for the encoding operation is part of the modulating apparatus. The modulation frequency is, for example, 10 MHZ.

(d) Zoom optics:

As focusing means there is used zoom optical system ZPO also called zoom projection optical system which permits varying the beam cross-sectional area. These is thus achieved the result that the beam cross-sectional area always assumes an approximately constant magnitude although the distance of the missile from the launch location or site increases continuously.

(e) Device or means for deflecting the modulated guide beam 3:

The guide beam 3 is deflected by means of a mirror, a prism, or by means of an acousto-optical or electro-optical crystal. The command or instruction syntax is given the further description hereinbelow and renders possible programming and controlling the deflecting device or means by means of a computer. Distinctions are made between different scanning methods, for example, the raster scan method or the vector scan method. During use of the raster scan method there is generated a checkerboard-type scanning pattern. During use of the vector scan method, there can be generated any desired type of scanning pattern, for example, concentric circles, spirals, and rectangular scanning patterns in carthesian or polar coordinates.

Figure 2:
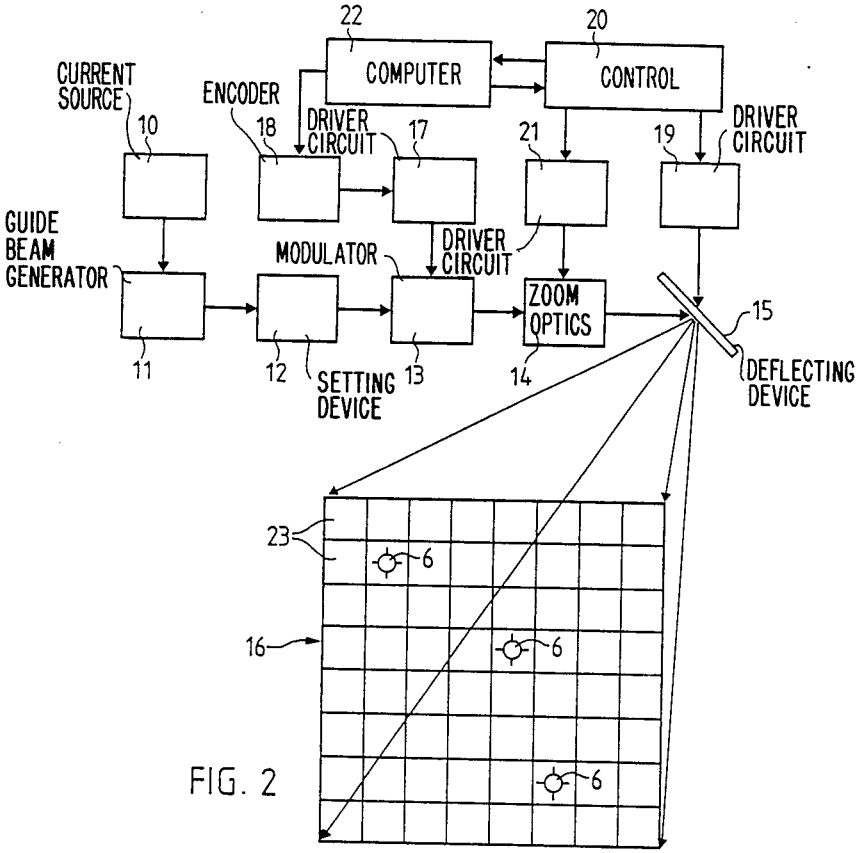
FIG. 2 shows a schematic block diagram of the guiding apparatus shown in FIG. 1 and in combination with several missiles.

According to FIG. 2, the guide beam generator or laser 11 which is powered by a current source 10, generates a guide beam 3. The divergence of the guide beam 3 is adjusted or set by the device or means 12 for diverting or fanning the guide beam 3. Subsequently the guide beam 3 is encoded by means of the modulator 13. The coded guide beam 3 is modified by means of the zoom optics 14 such that during the flight of the missile 6, for example, the cross-sectional area of the guide beam 3 is adjusted or set as a function of the missile distance.

The focused and coded guide beam 3 is deflected by a deflecting means or device 15 which generates the checkerboard-type scanning field 16. An encoder 18 is connected to the modulator 13 via a driver or driver circuit 17. A control device or element 20 is connected to the scanning mirror 15 via a driver or driver circuit 19. The control device or element 20 is also connected to the zoom optics 14 via a driver or driver circuit 21. The encoder 18 as well as the control device or element 20 are connected to a common computer 22. Missiles 6 are indicated in different field sectors 23 located within the checkerboard-type scanning field 16 which is associated with the guide beam 3.

The operation of the guiding apparatus described is as follows:

The checkerboard-type scanning field 16 shown in FIG. 2, comprises in each line and in each column 8 field sectors 23 and thus comprises $8\times8=64$ field sectors 23. The guide beam 3 remains or dwells at each field sector 23, for example, for a time period of $t_1=1.25$ msec. The guide beam 3, therefore, needs $8\times1.25=10$ msec for scanning one line and thereafter jumps to the start of the next-following line. For this purpose the guide beam 3 requires a time of, for example, $t_2=2.5$ msec. For scanning all of the lines, the guide beam 3 thus requires a time of $t_3=8\times(10+2.5)=100$ msec. The scanning mirror 16, therefore, oscillates at a frequency of $f_a=80$ Hz in line direction, i.e. in azimuth and at a frequency of $f_e=10$ Hz in column direction, i.e. in elevation.

Within the time period or interval of $t_1=1.25$ msec during which the guide beam 3 dwells in a field sector 23, all the required data associated with the guide beam 3 must be transmitted to a receiver in the missile 6. During this time period or interval $t_1$, the missile 6 receives information concerning the field sector 23 in which it is located. In the presence of 64 field sectors 23 there are required 3 bits each for designating the column and further 3 bits each for designating the line. Furthermore, there are communicated to the missile 6 data concerning the field sector of its destination and for this purpose an additional $2\times3=6$ bits are required. There are thus required $2\times6=12$ bits for indicating the actual position and the desired position of the missile 6. In the case that it is further necessary to transmit a reference bit for each one of the azimuth and the elevation, then, 14 bits are required for each field sector 23. This means that the modulator 13 must transmit 14 bits within 1.25 msec, i.e. one bit must be transmitted within 1.25 msec $\div14=82$ $\mu$sec. Thus, the modulator 13 must be operated at a frequency of 12 kHz. The modulator 13, however, is capable of operating at a maximum frequency of 10 MHz.

In order to avoid transmission errors, each data is thus transmitted not only once but ten times to the missile 6. Therefore, the modulator 13 must operate at a frequency of 120 kHz instead of 12 kHz. In this manner the disturbing influence of the atmosphere can be eliminated to a large extend. Furthermore, it is possible to transmit still further data. Particularly and by utilizing the natural beam distribution or by means of an additional modulation, the missile 6 can be guided into the center of the related field sector 23. Furthemore, the encoding of the scanning field 16 as described hereinbefore renders possible simultaneously guiding several missiles 6 in different field sectors 23 without there being required a change in the coding.

Different types of encoding can be utilized, particularly the analog methods, namely amplitude, frequency and phase modulation, as well as the digital methods, namely on/off keying, frequency-keying and phase-shift keying. In the present case, however, the digital methods are preferred, in particular the phase-shift keying method. During this operation, the encoding is achieved by a phase shift or jump relative to a reference signal.

If the phase shift or jump covers 180°, i.e. constitutes a phase reversal, there results the logical assignment "0" of "L" and if the phase shift or jump covers 0°, there results the logical assignment "1" or "H". The eight lines are each designated by three bits as follows:

000, 001, 010, 011, 100, 101, 110 and 111.

In the same manner, the eight columns are also designated each by the following three bits:

000, 001, 010, 011, 100, 101, 110 and 111.

Thus, the field sector 23 in the first line and in the first column has the code "000 000" and the field sector 23 in the last line and in the last column has the code "111 111".

Clearly, according to this principle also the frequency-keying method can be employed for the encoding operation. A first frequency A corresponds to the logic assignment "0", a second frequency B corresponds to the logic assignment "1". The remaining codes correspond to the abovementioned phase-shift keying method.

In order to achieve that the encoding operations in the transmitter and the decoding operations in the receiver proceed at the same phase, the encoder of the transmitter is synchronized with the decoder of the receiver prior to the launch of the missile 6.

Figure 3:
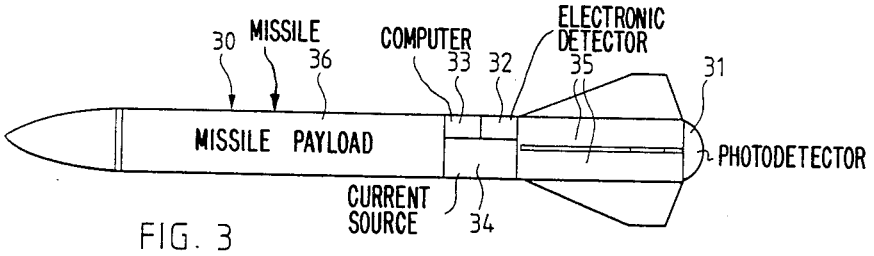
FIG. 3 shows a schematic view of a missile utilized in combination with the apparatus shown in FIGS. 1 and 2.

According to FIG. 3, the missile 30 comprises at its rear end or section a photodetector 31 containing a focussing or convex lens in front thereof and a narrow-band filter which is connected to an electronic detector system 32 of the photodetector 31. The electronic detector system 32 has incorporated therein an amplifier, a filter and a decoder. For determining the center of the scanning field 23, there is required a special electronic evaluation circuit in the missile 30. A computer 33 is connected with the electronic detector system 32 of the photodetector 31. Flying controls 35, for example, swing wings or jets are provided for guiding the missile 30. In the front section of the missile 30 there is located the pay load 36, for example, an explosive charge. A current source 34 is provided for supplying power to the various elements.

The aforedescribed guiding apparatus particularly permits simultaneously guiding a number of missiles so that a number of targets which are present at different locations can be attacked simultaneously.

While there are shown and described present preferred emboidments of the invention, it is to be distinctly understood that the invention is not limited thereto, but may be otherwise variously embodied and practiced within the scope of the following claims.

Accordingly,

What we claim is:

1. An apparatus for guiding a missile, comprising:

means for generating an electromagnetic guide beam guiding the missile along a trajectory leading to a target;

encoding means for encoding in said guide beam generated by said guide beam generating means, data required for guiding said missile along the trajectory leading to the target;

deflecting means for incrementally deflecting said encoded guide beam through a predetermined number of field sectors of a predetermined scanning field;

a computer; and said encoding means and said deflecting means being mutually coupled by means of said computer such as to generate individual codes associated with each one of said predetermined number of sector fields of said predetermined scanning field.

2. The apparatus as defined in claim 1, wherein:

said deflecting means deflects said encoded guide beam through a deflection pattern corresponding to a checkerboard-type scanning field; and said encoding means generating said individual code for each field sector of said checkerboard-type scanning field.

3. The apparatus as defined in claim 1, further including:

divergence adjusting means for adjusting the divergence of said guide beam generated by said guide beam generating means;

said encoding means containing a modulator for encoding said guide beam by modulating said guide beam; and optical means for adjusting the cross-sectional area of said modulated guide beam modulated by said modulator.

4. The apparatus as defined in claim 3, wherein:

said guide beam generatig means contain a laser for generating said guide beam.

5. The apparatus as defined in claim 4, wherein:

said laser for generating said guide beam constitutes a $CO_2$-laser.

6. The apparatus as defined in claim 4, wherein:

said laser for generating said guide beam constitutes a neodymium laser.

7. The apparatus as defined in claim 3, wherein:

said optical means for adjusting said cross-sectional area of said modulated guide beam contain a zoom optical system.

8. The apparatus as defined in claim 3, wherein:

said divergence adjusting means adjusting the diameter of said modulated guide beam.

9. The apparatus as defined in claim 3, wherein:

said modulator modulating said guide beam constitutes an acousto-optical crystal.

10. The apparatus as defined in claim 3, wherein:

said modulator modulating said guide beam constitutes an electro-optical crystal.

11. The apparatus as defined in claim 3, wherein:

said guide beam generating means contain a transmitter for emitting said guide beam toward the missile; and said divergence adjusting means adjusting said divergence of said guide beam in accordance with the distance of the missile from said transmitter emitting said guide beam.

12. The apparatus as defined in claim 1, wherein:

said deflecting means for incrementally deflecting said encoded guide beam contain a scanning mirror for incrementally deflecting said encoded guide beam through said predetermined number of field sectors of said predetermined scanning field.

13. The apparatus as defined in claim 1, wherein:

said deflecting means for incrementally deflecting said encoded guide beam contain a prism for incrementally deflecting said encoded guide beam through said predetermined number of field sectors of said predetermined scanning field.

14. The apparatus as defined in claim 1, wherein:

said deflecting means for incrementally deflecting said encoded guide beam contain an acousto-optical crystal for incrementally deflecting said encoded guide beam through said predetermined number of field sectors of said predetermined scanning field.

15. The apparatus as defined in claim 1, wherein:

said deflecting means for incrementally deflecting said encoded guide beam contain an electro-optical crystal for incrementally deflecting said encoded guide beam through said predetermined number of field sectors of said predetermined scanning field.

16. The apparatus as defined in claim 3, further including:

further modulating means; and said further modulating means further modulating said modulated guide beam in order to encode therein data identifying the center of each of one of said predetermined number of field sectors of said predetermined scanning field.

17. The apparatus as defined in claim 3, further including:

further optical means;

said guide beam generated by said guide beam generating means having a predetermined intensity distribution; and said further optical means modifying said predetermined intensity distribution of said guide beam such that the encoded and deflected guide beam has a maximum intensity in the region of the center of each one of said predetermined number of field sectors of said scanning field.

18. The apparatus as defined in claim 1, further including:

a receiver for receiving said guide beam generated by said guide beam generating means;

said receiver being located in the missile;

means for identifying the center of each one of said predetermined number of field sectors of said predetermined scanning field; and said center-identifying means being located in said receiver of said missile.

19. The apparatus as defined in claim 1, wherein:

said encoding means generating two codes for encoding said guide beam;

a first one of said two codes identifying the position of the missile in one of said predetermined number of field sectors of said predetermined scanning field; and a second one of said two codes identifying a further field sector of said predetermined number of said field sectors of said predetermined scanning field to which further field sector said missile is directed.

20. The apparatus as defined in claim 19, wherein:

said encoding means for encoding said guide beam permitting simultaneous guidance of a predetermined number of missiles which are directed to different ones of said predetermined number of field sectors of said predetermined scanning field.

* * * * *

UNITED STATES PATENT AND TRADEMARK OFFICE

CERTIFICATE OF CORRECTION

PATENT NO. : 4,709,875

DATED : December 1, 1987

INVENTOR(S) : GREGOR CREMOSNIK et al

It is certified that error appears in the above identified patent and that said Letters Patent is hereby corrected as shown below:

Column 1, line 14, please delete "each" and insert --such--

Column 4, line 10, please delete "pemits" and insert --permits--

Column 4, line 25, please delete "These" and insert --There--

Column 7, line 19, please delete "generatig" and insert --generating--

Signed and Sealed this

Seventeenth Day of May, 1988

*Attest:*

DONALD J. QUIGG

*Attesting Officer*

*Commissioner of Patents and Trademarks*